United States Patent [19]

Fotland et al.

[11] 4,365,549

[45] Dec. 28, 1982

[54] ELECTROSTATIC TRANSFER PRINTING

[75] Inventors: Richard A. Fotland, Holliston; Jeffrey J. Carrish, Hopkinton, both of Mass.

[73] Assignee: Dennison Manufacturing Company, Framingham, Mass.

[21] Appl. No.: 222,829

[22] Filed: Jan. 5, 1981

Related U.S. Application Data

[63] Continuation-in-part of Ser. No. 969,517, Dec. 14, 1978, Pat. No. 4,267,556, which is a continuation-in-part of Ser. No. 844,913, Oct. 25, 1977, abandoned.

[51] Int. Cl.[3] ..... G03G 15/22

[52] U.S. Cl. ..... 101/1; 346/153.1; 346/155; 346/159; 101/DIG. 13; 250/324

[58] Field of Search ..... 101/1, 426, DIG. 13; 346/153.1, 155, 159; 250/324, 326; 361/229, 230, 213, 220

[56] References Cited

U.S. PATENT DOCUMENTS

| | | | |
|---|---|---|---|
| 3,662,395 | 5/1972 | Dul et al. | 346/153.1 |
| 3,701,996 | 10/1972 | Perley | 346/153.1 |
| 4,048,921 | 9/1977 | Raschke | 101/426 |
| 4,096,489 | 6/1977 | Terazawa et al. | 346/155 |
| 4,137,537 | 1/1979 | Takahashi et al. | 346/159 |
| 4,155,093 | 5/1979 | Fotland et al. | 346/159 |
| 4,160,257 | 7/1979 | Carrish | 346/159 |
| 4,183,032 | 1/1980 | Ohbori et al. | 346/155 |
| 4,262,294 | 4/1981 | Hara et al. | 346/155 |
| 4,263,359 | 4/1981 | Kitts, Jr. | 346/153.1 |
| 4,267,556 | 5/1981 | Fotland et al. | 346/153.1 |

OTHER PUBLICATIONS

McCurry, "Contact Electrostatic Printing", *IBM Tech. Discl. Journal,* vol. 13, No. 10, Mar., 1971, pp. 3117–3118.

*Primary Examiner*—E. H. Eickholt

*Attorney, Agent, or Firm*—Arthur B. Moore; George E. Kersey

[57] ABSTRACT

Electrostatic transfer printing in which a latent electrostatic image is formed on a cylindrical dielectrical member by means of a glow discharge ion source. The image is then toned and pressure-transferred to a receptor, such as a sheet of paper, which is passed between the cylindrical dielectric member and a transfer roller. Scraper blades may be included to remove residual toner from the cylindrical dielectric member and the transfer roller. Means may also be included to erase any latent residual electrostatic image on the cylindrical dielectric member.

35 Claims, 11 Drawing Figures

ELECTROSTATIC TRANSFER PRINTING

This application is a continuation-in-part of application Ser. No. 969,517, filed Dec. 14, 1978 now U.S. Pat. No. 4,267,556 which is a continuation-in-part of application Ser. No. 844,913, filed Oct. 25, 1977 and now abandoned.

BACKGROUND OF THE INVENTION

This invention relates to transfer printing, and more particularly to electrostatic transfer printing.

Various types of electrostatic transfer printers can be found in the prior art. Examples are F. A. Schwertz U.S. Pat. No. 3,023,731; Richmond Perley U.S. Pat. No. 3,701,996; and T. Doi et al., U.S. Reissue Pat. No. 28,693. Electrostatic transfer printers may be classified generally according to the way in which the latent electrostatic image is formed. One prior art approach utilizes metal styli at minute distances from the surface of the dielectric transfer drum. The styli are electrically pulsed to provide a latent electrostatic image by air gap breakdown. This technique has the disadvantage of not allowing for multiplexing of the charging styli. In addition, the necessity for maintaining a very small air gap breakdown distance requires extremely close tolerances which limit the practicability of this technique.

Air gap breakdown, i.e. discharges occuring in small gaps between electrodes, or between a conductive surface and the surface of a dielectric material, are widely employed in the formulation of electrostatic images. Representative U.S. Pat. Nos. are G. R. Mott 3,208,076; R. F. Howell 3,438,053; E. W. Marshall 3,631,509; A. D. Brown, Jr. 3,662,396; R. T. Lamb 3,725,950; A. E. Bliss et al. 3,792,495; G. Krekow et al. 3,877,038; R. F. Borelli 3,958,251; and Terazawa 4,096,489.

Another type of electrostatic printer found in the prior art employs an ion source in the form of a corona point or wire used together with an image defining mask. U.S. Pat. No. 3,863,261 to Klein illustrates this type of ion generating apparatus. Because of the inherently low current densities available from traditional corona discharges, this method is impractical for high speed printing. The use of coronas also poses significant difficulties in maintenance. Corona wires are fragile, and because of their high operating potentials, tend to collect dirt and dust. Hence they must be frequently cleaned or replaced.

Corona discharge devices which enjoy certain advantages over standard corona apparatus are disclosed in Sarid et al., U.S. Pat. Nos. 4,057,723; Wheeler et al. 4,068,284; and Sarid 4,110,614. These patents disclose various corona charging devices characterized by a conductive wire coated with a relatively thick dielectric material, in contact with or closely spaced from a further conductive member. A supply of positive and negative ions is generated in the air space surrounding the coated wire, and ions of a particular polarity are extracted by a direct current potential applied between the further conductive member and a counterelectrode. Such apparatus overcomes many of the above-mentioned disadvantages of prior art corona charge and discharging devices but is unsuitable for electrostatic imaging. This limitation is inherent in the feature of large area charging, which does not permit formation of discrete, well-defined electrostatic images.

Furthermore, these devices are characteristically maintained at greater distances from the member to be charged or discharged than is characteristic of the imaging device of the present invention, and hence require substantially greater extraction potentials. Another approach to electrostatic transfer printing focuses on the method by which the toned image is transferred and fused onto the receptive sheet. The transfer printing system of R. Perley, U.S. Pat. No. 3,701,996, involves simultaneous transfer and pressure fusing by passing a receptive sheet between the transfer and pressure drums. This patent does not contain sufficient teachings of suitable roller materials and characteristics to enable the skilled artisan to make or use such a printer. The Perley printer creates the latent electrostatic image using corona styli, which imposes limitations on image quality and speed of operation. In P. Pederson, U.S. Pat. No. 3,874,894, a nylon-six sleeve is provided on at least one of a pair of pressure rolls, but the drums are used only for fixing the already transferred toner, an arrangement which adds significant complexity to the overall system. Brenneman et al. U.S. Pat. No. 3,854,975, discloses pressure fixing apparatus involving a pair of compliant rollers, or a compliant roller and a relatively rigid roller; again, such apparatus is used only to fuse a previously transferred toner image.

Accordingly, it is an object of the invention to facilitate electrostatic transfer printing. A related object is to reduce critical mechanical tolerances in providing a latent electrostatic image. Another related object is to reduce the maintenance problems associated with the formation of such an image.

A further object of the invention is to achieve increased electrostatic printing speed. A related object is to do so by using a reliable, easily controlled ion source. A still further object is to achieve relatively uniform charge images which may be toned with good definition and dot fill. A further related object is to provide a matrix selection (or multiplexed) method of dot matrix printing.

Another object of the invention is to achieve an image-bearing member with surface resistivity sufficient to prevent image degradation from the time when the image is presented to the surface until the image is toned. Still another object is to utilize a surface with high abrasion resistance, and sufficient smoothness to provide complete transfer of toner to a receptor sheet. A still further object is to realize a transfer surface not subject to significant distortion.

Yet another object is to facilitate the erasure of latent residual electrostatic images. A related object is to avoid ghost images in subsequent printing cycles.

SUMMARY OF THE INVENTION

In accomplishing the foregoing and related objects, the invention provides an electrostatic printing system in which a latent electrostatic image is formed on a cylindrical dielectric member by means of a "glow discharge" ion generator, comprising two electrodes separated by a solid dielectric. The latent electrostatic image is then toned to form a visible counterpart which is pressure transferred to a receptor. In the preferred embodiment, the pressure transfer of toner is effected with simultaneous fusing, obviating the need for post-fusing.

In the preferred print head embodiment, the glow discharge ion generator includes two electrodes which are essentially in contact with opposite sides of the solid dielectric member. An air region is located within one or more apertures in a first electrode, these apertures being located opposite a second electrode.

In accordance with an alternative print head embodiment, the glow discharge ion generator is characterized by an elongate conductor with a dielectric sheath, in contact with or minutely separated from one or more transversely oriented conductive members. In one version of this embodiment, one or more dielectric-coated wires are transversely disposed over an array of parallel strip electrodes, which are mounted on an insulating substrate. In other versions of this embodiment, one or more dielectric-coated wires are embedded in an insulating channel, with a transversely oriented array of strip electrodes or conductive wires mounted over the embedded wire.

In accordance with a further aspect of the invention, in any of the above embodiments the glow discharge ion generator includes a "driver electrode" and a "control electrode". A high voltage, high frequency discharge is initiated between the control electrode and the solid dielectric, creating a pool of positive and negative ions. In the preferred embodiment, this ion pool is generated within the apertures in the control electrode, and ions are extracted by means of an auxiliary direct voltage applied to the control electrode in order to form a latent electrostatic image on the cylindrical dielectric member. In the preferred version of any of the alternative embodiments, the dielectric-coated wire comprises the driver electrode, and the transversely oriented conductive member comprises the control electrode. The ion pool is formed in the air space surrounding a dielectric-coated electrode at a crossover point with the transverse electrode, and ions are extracted therefrom by means of a direct current potential applied to the control electrode as in the preferred embodiment. An alternative driving scheme employs the dielectric-coated electrode as the control electrode.

In an advantageous version of any of the above embodiments, the image forming ion generator takes the form of a multiplexed matrix of control electrodes and driver electrodes. In the preferred embodiment, the ion generator consists of a matrix of finger electrodes and selector bars, separated by a solid dielectric layer. Ions are generated in apertures in the finger electrodes at matrix crossover points. In any of the alternative embodiments, the ion generator consists of a matrix of dielectric-coated wires and transversely oriented conductive members. Ions are generated in the air space surrounding the dielectric-coated wires at matrix crossover points. In all of the above embodiments, ions may be extracted to form on the dielectric cylinder a latent electrostatic image consisting of discrete dots. Any of the above matrix ion generators may be combined with an apertured "screen" electrode, which is located between the ion pool and the dielectric cylinder. The screen electrode electrically isolates the print head from potentials appearing on the dielectric cylinder, thereby preventing accidental image erasure.

In the preferred disposition of any of the ion generators, the print head is spaced from the dielectric cylinder by more than 1 mil, most preferably on the order of one hundredth of an inch.

In accordance with yet another aspect of the invention, the cylindrical dielectric member consists of a dielectric surface layer and a conductive core. In accordance with a related aspect, the surface of the cylindrical dielectric member has a smoothness in excess of 20 micro-inch rms., and a resistivity in excess of $10^{12}$ ohm-centimeters. The dielectric surface can be of a material selected from the class comprising aluminum oxide, glass enamel, and resins including polyimides and nylon. In the preferred embodiment, the dielectric cylinder is fabricated by anodically forming an oxide surface layer on an aluminum cylinder, dehydrating the pores of the oxide layer, and impregnating the pores to form a dielectric surface. The impregnant material may comprise an organic resin, or advantageously a metallic salt of a fatty acid.

The cylindrical dielectric member contacts a transfer roller, with a receptor (such as a sheet of paper) fed between. The transfer roller is advantageously coated with a stress-absorbing plastics material such as nylon or polyester. The dielectric cylinder and transfer roller may be skewed to provide enhanced toner transfer efficiency.

Other aspects of the invention include a scraper for removing residual toner from the dielectric member, and an eraser unit for eradicating any remaining electrostatic image after transfer printing has been effected. Any residual image on the imaging drum can be erased by an ion generator of the same type as the preferred print head of the invention. Erasure can also be effected by a grounded conductor or grounded semiconductor maintained in intimate contact with the surface of the dielectric layer. The grounded conductor can be a heavily loaded metal scraper blade and the grounded semiconductor can be a semiconductive roller.

BRIEF DESCRIPTION OF THE DRAWINGS

Other aspects of the invention will become apparent after considering the drawings and detailed description below.

DETAILED DESCRIPTION

Figure 1:
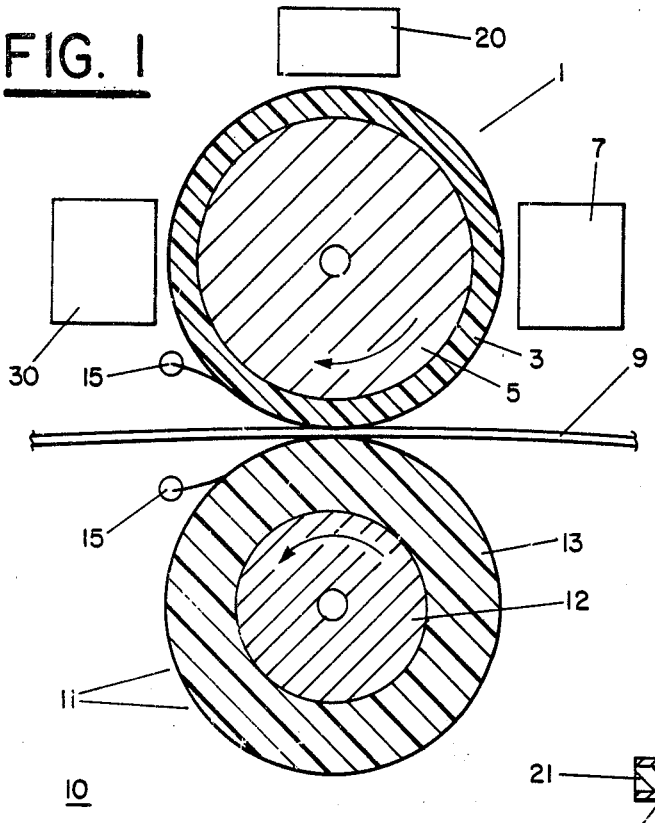
FIG. 1 is a schematic view of an electrostatic transfer printer in accordance with the invention.

An electrostatic printer 10 in accordance with the invention is shown schematically in FIG. 1. The printer 10 is formed by two cylinders or rollers 1 and 11, along with a number of process stations. The upper roller 1 shown in FIG. 1 consists of a conductive core 5 coated with a thin layer 3 of dielectric material, while the lower pressure roller 11 desirably includes a metallic core 12 coated with an engineering thermoplastic material 13. A latent electrostatic image in the pattern of the imprint that is to be made is provided on the dielectric layer 3 by a charging head 20. The latent image is then toned, for example by charged, colored particulate matter, at a station 7, following which the toned image undergoes essentially total pressure transfer with simultaneous fusing to a receptor sheet 9 to form the desired imprint. The electrostatic printer of FIG. 1 desirably includes scraper blades 15 and a unit 30 for erasing any latent residual electrostatic image that remains on the dielectric layer 3 before reimaging takes place at the charging head 20.

With respect to the individual components of the printer, the roller 1 is provided with the dielectric layer 3 having sufficiently high resistance to support a latent electrostatic image during the period between latent image formation and toning. Consequently, the resistivity of the layer 3 must be in excess of $10^{12}$ ohm-centimeters. The insulating layer 3 should be highly resistant to abrasion and relatively smooth, with a finish that is preferably better than 20 microinch rms, in order to provide for complete transfer of toner to the receptor sheet 9. This layer advantageously has a thickness of around 1–2 mils. The dielectric layer 3 additionally has a high modulus of elasticity so that it is not distorted significantly by high pressures in the transfer nip.

A number of organic and inorganic dielectric materials are suitable for the layer 3. Glass enamel, for example, may be deposited and fused to the surface of a steel or aluminum cylinder. Flame or plasma sprayed high density aluminum oxide may also be employed in place of glass enamel. Plastic materials, such as polyimides, nylons, and other tough thermoplastic or thermoset resins are also suitable. However, the preferred dielectric coating is impregnated, anodized aluminum oxide as described in the copending patent application of R. A. Fotland, Ser. No. 072,524, which is a continuation-in-part of Ser. No. 822,865, filed Aug. 8, 1977. A particularly advantageous class of impregnant materials, metallic salts of fatty acids, is disclosed in the co-pending patent application of L. A. Beaudet et al., Ser. No. 164,482, which is a continuation-in-part of Ser. No. 155,354, filed June 2, 1980, commonly assigned with the present invention.

The latent electrostatic image produced on the layer 3 is provided by the charging head 20 by extracting ions from a discharge that is remote from the dielectric surface. A suitable ion generation and extraction technique, as disclosed in co-pending patent application Ser. No. 939,727 and in U.S. Pat. No. 4,155,093, involves the generation of ions by high frequency, high voltage discharges between two electrodes separated by a dielectric. Auxiliary fields extract ions from the discharge to charge the surface of dielectric layer 3.

Figure 2:
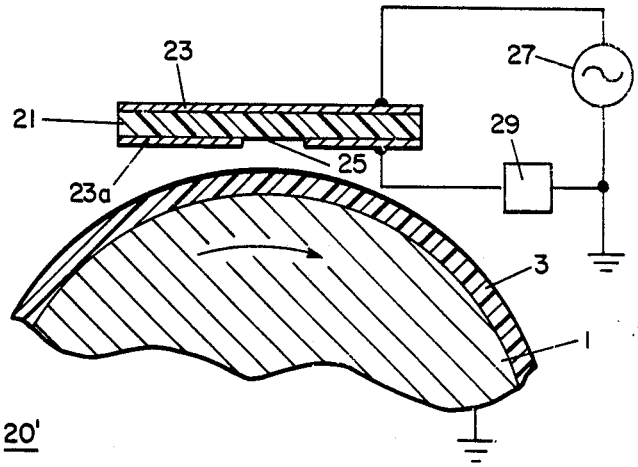
FIG. 2 is a partial sectional view of a generator and ion extractor for the printer of FIG. 1.

In FIG. 2, electrodes 23 and **23*a* are separated by a thin dielectric layer 21. Electrode 23*a* contains an aperture 25 in which a discharge is caused to be formed through the application of the high voltage alternating potential supplied by generator 27. In order to charge the surface of dielectric 3, an extraction voltage pulse is supplied between electrode 23*a* and ground (the reference potential of metallic core 5) via pulse generator 29. Aperture 25 is advantageously disposed at more than one thousandth of an inch above dielectric layer 3**.

Suitable materials for dielectric plate 21 include aluminum oxide, glass enamels, ceramics, plastic films, and mica. Aluminum oxide, glass enamels and ceramics present difficulties in fabricating a sufficiently thin layer (i.e. around 1 mil) to avoid undue demands on generator 27. Plastic films, including polyimides such as Kapton (Kapton is a trademark of E. I. Dupont de Nemours & Co., Wilmington, Del.) and Nylon, tend to degrade as a result of exposure to chemical byproducts of the air gap breakdown process in aperture 25 (notably ozone and nitric acid). Mica avoids these drawbacks, and is therefore the preferred material for dielectric 21. Especially preferred is Muscovite mica, $H_2KAl_3(SiO_4)_3$. In general practice, for dot matrix printing, electrode **23*a*** is provided with a multiplicity of holes. In order to generate a latent electrostatic dot image from any one hole, two potentials must be present simultaneously, the generating discharge potential and the ion extraction potential. This permits dot matrix multiplexing and significantly reduces the number of interconnections and pulse drive sources required for the formation of dot matrix characters.

Figure 5:
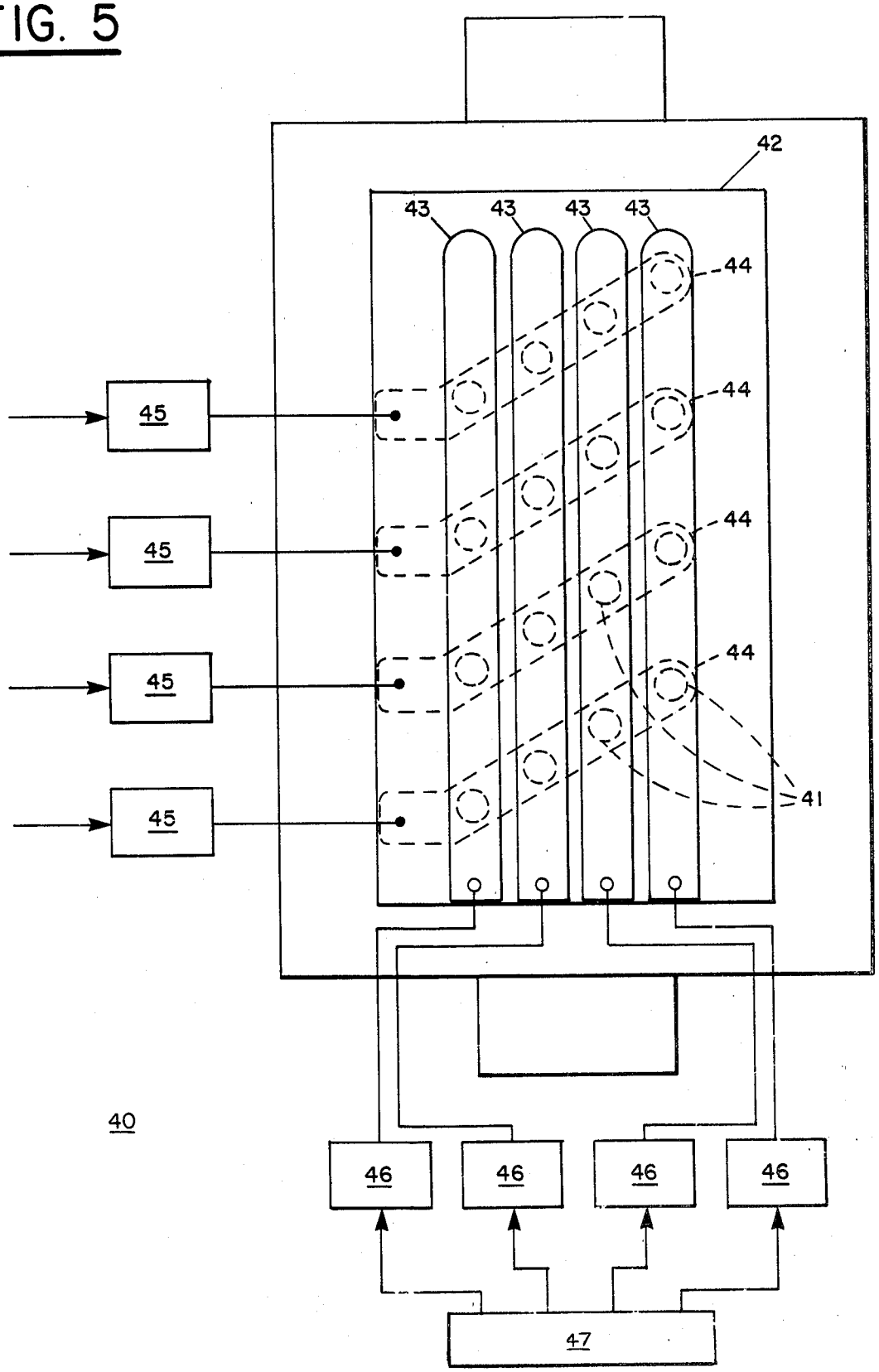
FIG. 5 is a plan view of a multiplexed ion generator of the type shown in FIG. 2.

FIG. 5 shows in a plan view a multiplexed ion generator 40 of the above type. The ion generator 40 includes a series of finger electrodes 44 and a crossing series of selector bars 43 with an intervening dielectric layer 42. Ions are generated at apertures 41 in the finger electrodes at matrix crossover points. Ions can only be extracted from an aperture 41 when its selector bar is energized by a high voltage alternating potential supplied by one of gated oscillators 46, and simultaneously its finger electrode is energized by a direct current potential supplied by one of pulse generators 45. The timing of gated oscillators 46 is advantageously controlled by a counter 47.

Figure 6A:
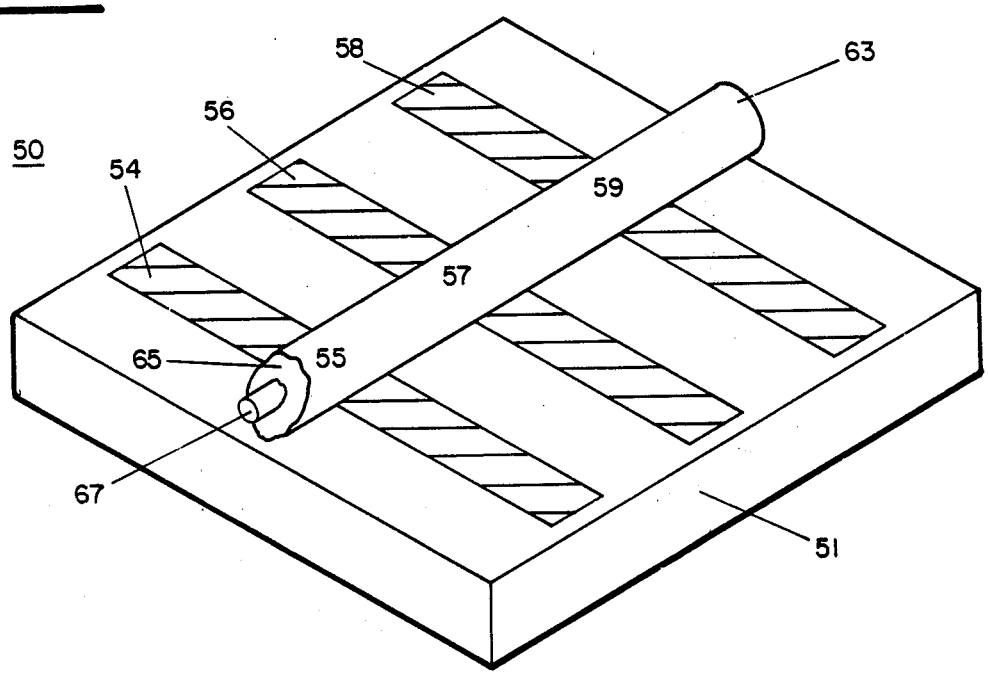
FIG. 6A is a perspective view of an alternative charging head.

FIG. 6A illustrates an alternative type of ion generator for producing a latent electrostatic image on dielectric layer 3. Print head 50 includes a series of parallel conductive strips 54, 56, 58, etc. laminated to an insulating support 51. One or more dielectric-coated wire electrodes 63 are transversely oriented to the conductive strip electrodes. The wire electrodes are mounted in contact with or at a minute distance above (i.e. on the order of mils) the strip electrodes. Wire electrodes 63 consist of a conductive wire 67 (which may consist of any suitable metal) encased in a thick dielectric material 65. In the preferred embodiment, the dielectric 65 comprises a fused glass layer, which is fabricated in order to minimize voids. Other dielectric materials may be used in the place of glass, such as sintered ceramic coatings. Organic insulating materials are generally unsuitable for this application, as most such materials tend to degrade with time due to oxidizing products formed in atmospheric electrical discharges. Although a dielectric-coated cylindrical wire is illustrated in the preferred embodiment, the electrode 63 is more generally defined as an elongate conductor of indeterminate form of cross-section, with a dielectric sheath.

Crossover points 55, 57, 59, etc. are found at the intersection of coated wire electrodes 63 and the respective strip electrodes 54, 56, 58, etc. An electrical discharge is formed at a given crossover point as a result of a high voltage alternating potential supplied by a generator 62 between wire 67 and the corresponding strip electrode. Crossover points 55, 57, 59, etc. are preferably positioned between 5 and 20 mils. from the surface of dielectric layer 3 (see FIG. 6B).

The currents obtainable from an ion generator of the type illustrated in FIG. 6A may be readily determined by mounting a current sensing probe at a small distance above one of the crossover points 55, 57, 59, etc. Current measurements were taken using an illustrative AC excitation potential of 2000 volts peak-to-peak at a resonant frequency of 1 MHz., pulse width of 25 microseconds and repetition period of 500 microseconds. A DC extraction potential of 200 volts was applied between the strip electrode and a current sensing probe spaced 8 mils above the dielectric-coated wire 63. Currents in the range from about 0.03 to 0.08 microamperes were measured at AC excitation potentials above the air gap breakdown value, which for this geometry was approximately 1400 volts peak-to-peak. At excitation voltages above the breakdown value, the extracted current varied linearly with excitation voltage. The extracted current varied linearly with extraction voltage, as well. For probe-coated wire spacings in the range 4–20 mils, the extracted current was inversely proportional to the gap width. Under 4 mils, the current rose more rapidly.

Figure 6B:
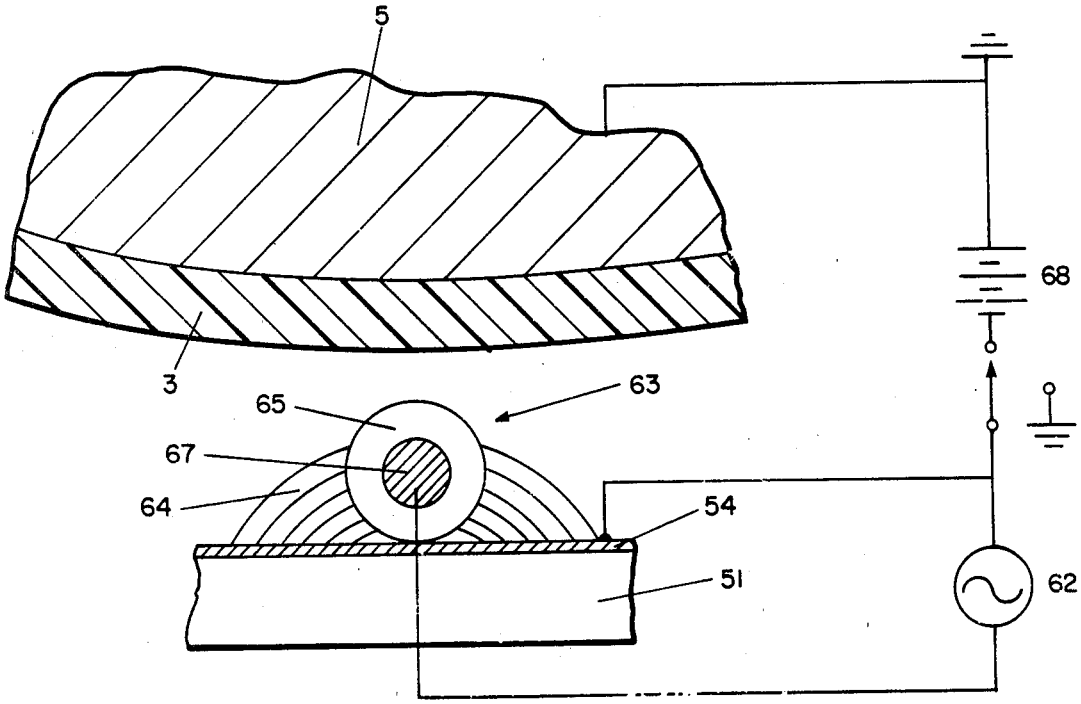
FIG. 6B is a partial sectional view of the charging head of FIG. 6A, in conjunction with the dielectric cylinder of FIG. 1.

With reference to the sectional view of FIG. 6B, ions are extracted from an ion generator of the type shown in FIG. 6A to form an electrostatic latent image on dielectric surface 3. A high voltage alternating potential 62 between elongate wire 67 and transverse electrode 54 results in the generation of a pool of positive and negative ions as shown at 64. These ions are extracted to form an electrostatic image on dielectric surface 3 by means of a DC extraction voltage 68 between transverse electrode 54 and the conducting core 5 of image cylinder 1. Because of the geometry of the ion pool 64, the extracted ions tend to form an electrostatic image on surface 3 in the shape of a dot.

Figure 7:
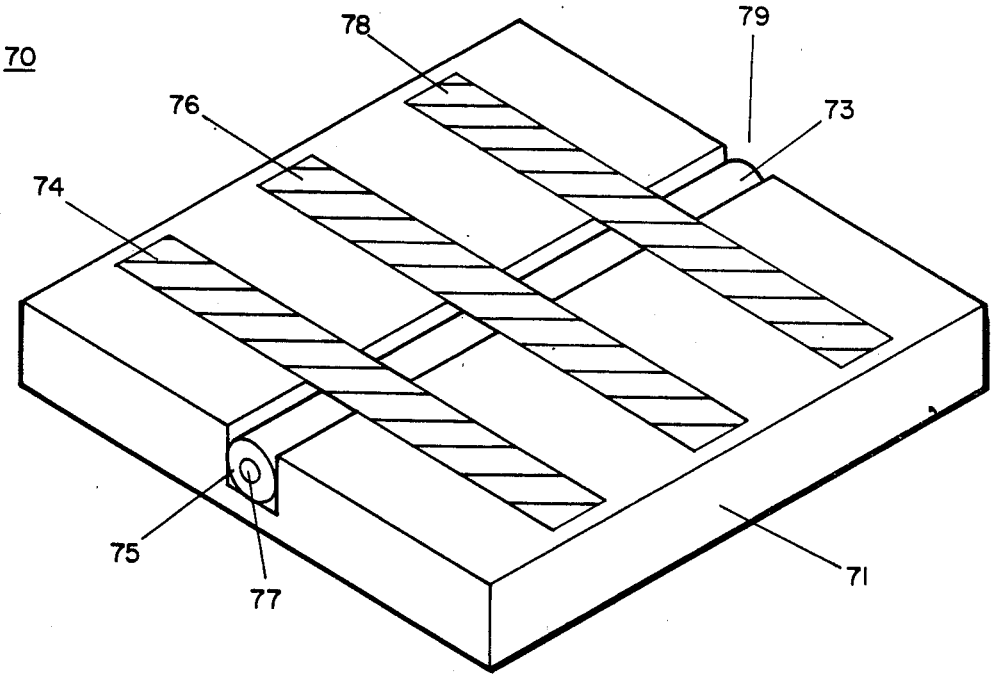
FIG. 7 is a perspective view of a further charging head embodiment.

A further embodiment of charging head 20 is illustrated in FIG. 7, showing a print head 70 similar to that illustrated in FIG. 6A, but modified as follows. The dielectric-coated wire 73 is not located above the strip electrodes, but instead is embedded in a channel 79 in insulating support 71. The geometry of this arrangement may be varied in the separation (if any) of delectric-coated wire 73 from the side walls 72 and 74 of a channel formed in the support 71; and in the protrusion (if any) of wire electrode 73 from this channel.

Figure 8:
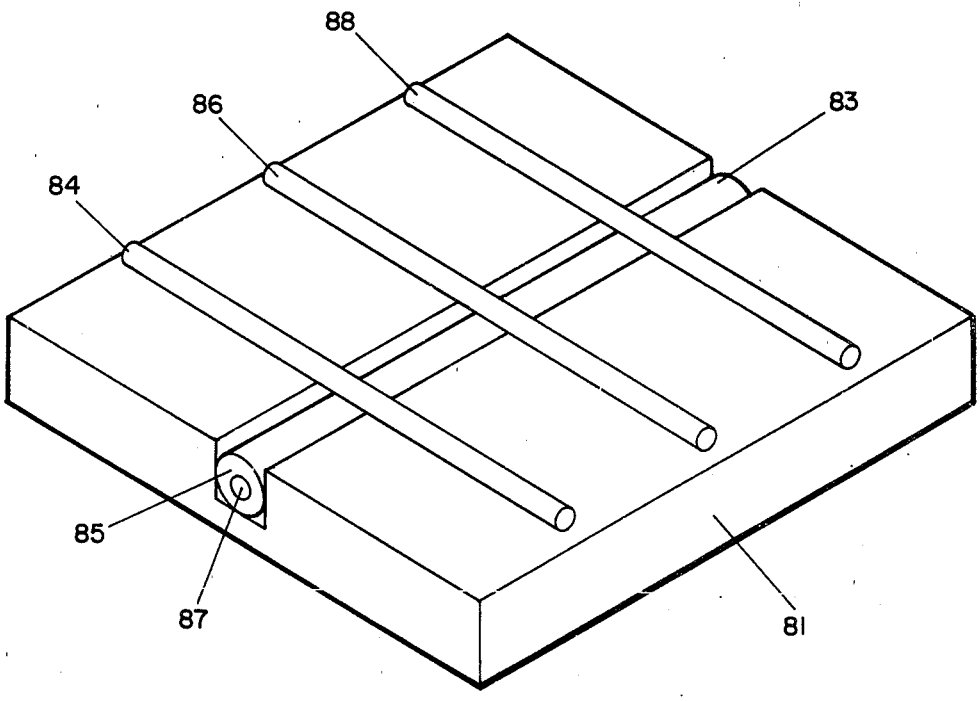
FIG. 8 is a perspective view of a modified embodiment of the charging head of FIG. 7.

FIG. 8 is a perspective view of an ion generator 80 of the same type as that illustrated in FIG. 7, with the modification that the strip electrodes 84, 85, 86, and 87 are replaced by an array of wires. In this embodiment wires having small diameters are most effective and best results are obtained with wires having a diameter between 1 and 4 mils.

The air breakdown in any of the dielectric-coated conductor embodiments occurs in a region contiguous to the junction of the dielectric sheath and transverse conductor (see FIG. 6B). It is therefore easier to extract ions from the print heads of FIGS. 7 and 8 than from that of FIG. 6A, in that this region is more accessible in the former embodiments. The ion pool may extend as far as 4 mils from the area of contact, and therefore may completely surround the dielectric sheath where the latter has a low diameter.

In the preferred embodiment, the transverse conductors contact the dielectric sheath. As the separation of these members has a critical effect on ion current output, it is advisable that the structures be placed in contact in order to maintain consistent outputs among various crossover points. This also has the benefit of minimizing driving voltage requirements. It is feasible, however to separate these structures by as much as 1–2 mil.

FIGS. 6A, 7 and 8 illustrate various embodiments involving linear arrays of crossover points or print locations. Any of these may be extended to a multiplexable two dimensional matrix analogous to that shown in FIG. 5, by adding additional dielectric-coated conductors. An electrostatic dot image is formed on dielectric layer 3 when an extraction potential and an AC excitation potential are simultaneously applied to define a discrete crossover location.

In any of the two dimensional matrix print heads, there is a danger of accidentally erasing all or part of a previously formed electrostatic dot image. This occurs in the ion generator illustrated in FIG. 5 when an aperture 25 is placed over a previously deposited dot image, and a high voltage potential is supplied by generator 27. If in such case no extraction voltage pulse is supplied between electrode **23*a* and ground, the previously established dot image will be totally or partially erased. A similar image erasure may occur in a two dimensional version of any of the embodiments involving elongate conductors coated with a dielectric. In the ion generator of FIG. 2, this phenomenon may be avoided by the inclusion of an additional, apertured "screen" electrode between the control electrode 23*a* and dielectric layer 3, as disclosed in U.S. Pat. No. 4,160,257. The screen electrode acts to electrically isolate the potential on the dielectric surface of roller 1**, and may be additionally employed to provide an electrostatic lensing action.

Figure 9:
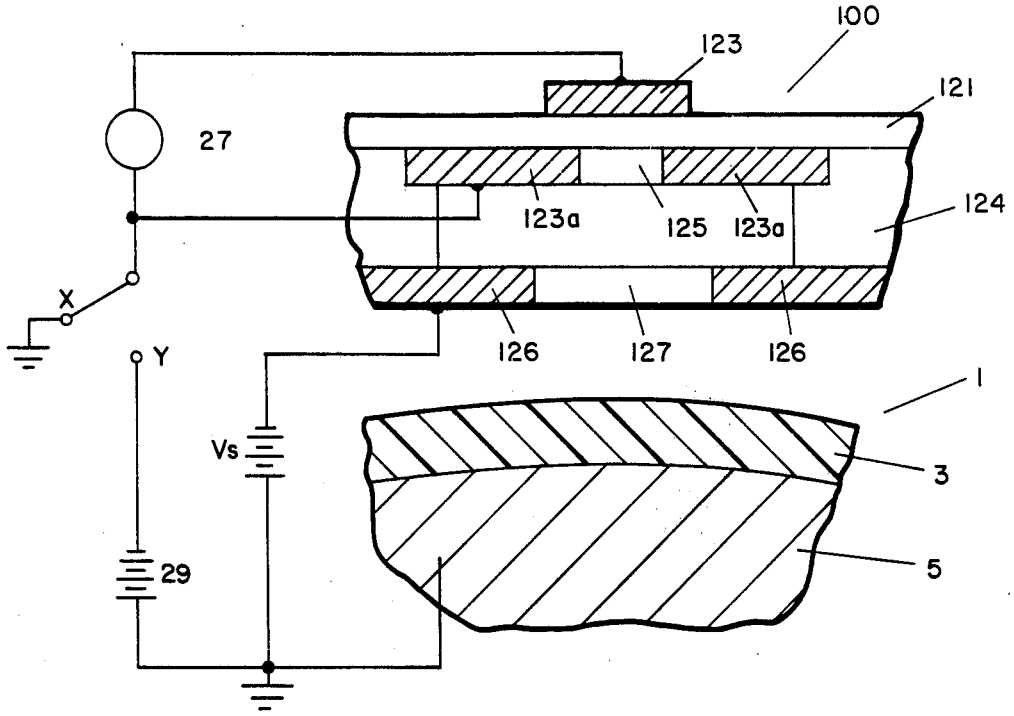
FIG. 9 is a schematic view of a three electrode version of the print head of FIG. 2.
Figure 10:
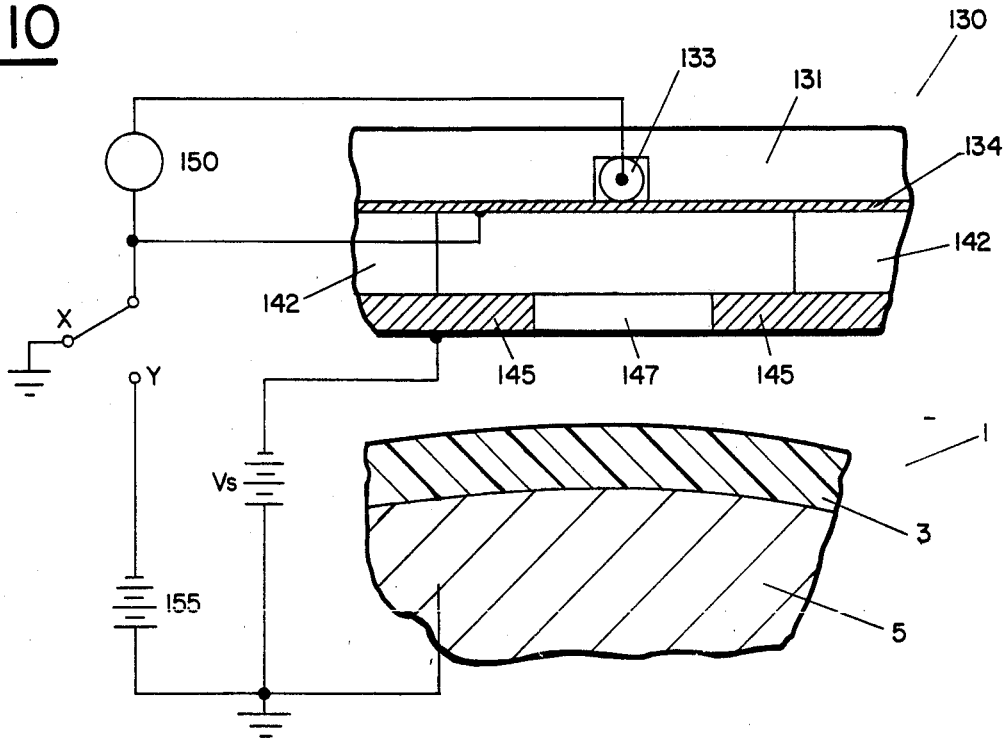
FIG. 10 is a schematic view of a three electrode version of the print head of FIG. 7.

FIG. 9 illustrates an ion generator 100 of the type disclosed in U.S. Pat. No. 4,160,257. The structure of FIG. 2 is supplemented with a screen electrode 126, which is isolated from control electrode **123*a* and dielectric 121 by a dielectric spacer 124. A similar modification may be made in the matrix version of any of the "coated wire" print head embodiments of FIGS. 6–8. FIG. 10 illustrates an appropriate modification of the print head of FIG. 7**. The lensing action provided by the apertured electrode results in improved image definition in any of the alternative print head embodiments, at the cost of decreased ion current output.

All of the above charging heads are characterized by the presence of a "glow discharge," a silent discharge formed in air between two conductors separated by a solid dielectric. Such discharges have the advantage of being self-quenching, whereby the charging of the solid dielectric to a threshold value will result in an electrical discharge between the solid dielectric and the control electrode. By application of an alternating potential, glow discharges are generated to provide a pool of ions of both polarities. References to "alternating" in this specification shall include fluctuating wave forms, with or without a DC component, that provide air breakdown in opposite directions.

It is useful to characterize all of the charging head embodiments in terms of a "control electrode" and a "driver electrode." The control electrode is maintained at a given DC potential in relation to ground, while the driver electrode is energized around this value using a high voltage AC or DC pulse source. In the planar electrode embodiment of FIG. 2, the apertured conductor constitutes the control electrode; in all of the illustrated alternative embodiments the coated conductor or wire constitutes the driver electrode. In another driving scheme for any of the alternative embodiments, the coated conductor is employed as the control electrode.

The latent electrostatic image produced by charging head 20 is rendered visible by toning at station 7. While any conventional electrostatic toner may be used, the preferred toner is of the single component conducting magnetic type described by J. C. Wilson, U.S. Pat. No.

2,846,333, issued Aug. 5, 1958. This toner has the advantage of simplicity and cleanliness.

The toned image is transferred and fused onto a receptive sheet 9 by high pressure applied between rollers 1 and 11. The bottom roller 11 consists of a metallic core which may have an outer covering of engineering thermoplastic 13. The pressure required for good fusing to plain paper is governed by such factors as, for example, roller diameter, the toner employed, and the presence of any coating on the surface of the paper. Typical pressures range from 100 to 500 lbs. per linear inch of contact. The function of the plastic coating 13 is to absorb any high stresses introduced into the nip in the case of a paper jam or wrinkle. By absorbing stress in the plastic layer 13, the dielectric-coated roller 1 will not be damaged during accidental paper wrinkles or jams. Coating 13 is typically a nylon or polyester sleeve having a wall thickness in the range of $\frac{1}{8}$ to $\frac{1}{2}''$. This coating need not be used, for example, if a highly controlled web is printed for which paper wrinkles and jams are not likely to occur.

In a preferred embodiment of the invention, rollers 1 and 11 are skewed (i.e. disposed in a nonparallel orientation) as disclosed in co-pending patent application of L. A. Beaudet, Ser. No. 180,218, commonly assigned with the present invention. Advantageously, roller 11 is mounted at an angle in the range 0.5°–1.1°, measured as the angle between the roller axes. The skewing of rollers 1 and 11 provides a marked improvement in toner transfer efficiency i.e. the percentage of the toner image on dielectric surface 3 which is transferred to plastic coating 13. This results in a reduction of residual toner by a factor of up to 500. The reduction of residual toner increases the service life of the various process stations associated with roller 1.

Scraper blades 15 serve to clean any residual paper or toner dust from the pressure rollers 1 and 11. Since substantially all of the toned image is transferred to the receptor sheet 9 in the skewed roller embodiment, the scraper blades are not required, but are desirable in promoting reliable operation over an extended period.

Figure 3:
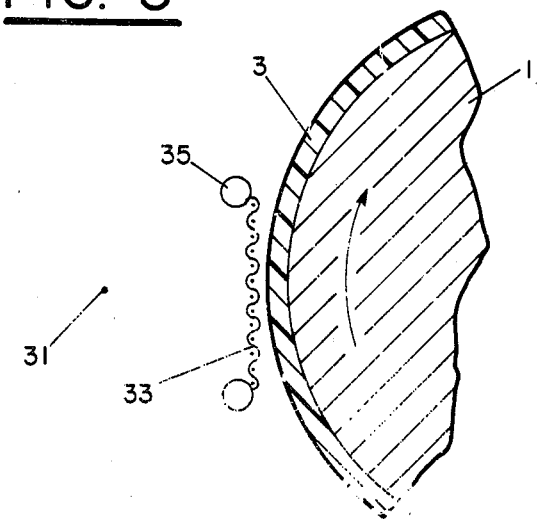
FIG. 3 is a partial sectional view of a charge eraser unit for the printer of FIG. 1.

The electrostatic printer 10 may also include an eraser unit 30 for eliminating any latent electrostatic image. The action of toning and transferring a toned latent image to a plain paper sheet reduces the magnitude of the electrostatic image, typically from several hundred volts to seveeral tens of volts. In some cases, if the toning threshold is too low, the presence of a residual latent image will result in ghost images on the copy sheet; this effect is eliminated by the eraser unit 30. Such erasure may be performed with arrangement 30 of FIG. 3. In FIG. 3, the roller 1, with a dielectric coating 3, is maintained in contact with, or a short distance from, an open mesh screen 33, maintained at substantially the same potential as the conductive core 5. The screen is mounted on holder 35, and an AC corona wire 31 is positioned behind the screen at a distance of typically $\frac{1}{4}$ to $\frac{1}{2}''$. A high voltage alternating potential, illustratively 60 Hertz, is applied to the wire 31. The screen 33 establishes a reference ground plane near the dilectric surface and the AC corona wire 31 supplies both positive and negative ions. Any local field at the screen 33 due to a latent electrostatic image on the dielectric surface 3 attracts ions generated by the corona wire 31 onto the the dielectric layer, thus neutralizing the majority of any residual charge. At very high surface velocities of dielectric coating 3, the remaining charge can again result in ghost images. In this case, multiple discharge stations will further reduce the residual charge to a level below the toning threshold.

Alternatively, erasure of any latent electrostatic image can be accomplished by using a high frequency AC discharge between electrodes separated by the dielectric as described in U.S. Pat. No. 4,155,093.

Figure 4:
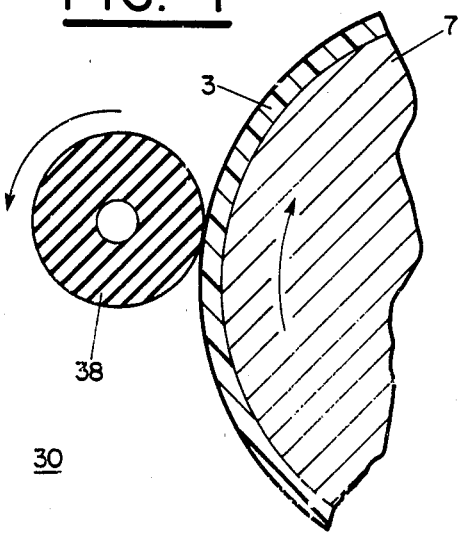
FIG. 4 is a partial sectional view of a charge eraser unit for the printer of FIG. 1 in accordance with an alternative embodiment of the invention.

The latent residual electrostatic image may also be erased by contact discharging. The surface of the dielectric must be maintained in intimate contact with a grounded conductor or grounded semi-conductor in order effectively to remove any residual charge from the surface of the dielectric layer 1, for example, by a heavily loaded metal scraper blade. The charge may also be removed by a semiconducting roller which is pressed into intimate contact with the dielectric surface. FIG. 4 shows a partial sectional view of a semiconductor roller 38 in rolling contact with dielectric surface 3. Roller 38 advantageously has an elastomer outer surface.

EXAMPLE ONE

In a specific operative example of an electrographic printer in accordance with the invention, the cylindrical conducting core 5 of the dielectric cylinder 1 was machined from 7075-T6 aluminum to a 3 inch diameter. The length of the cylindrical core, excluding machined journals, was 9 inches. The journals were masked and the aluminum anodized by use of the Sanford Process (see S. Wernick and R. Pinner, "The Surface Treatment and Finishing of Aluminum and Its Alloys", Robert Draper Ltd. fourth edition, 1971/72 volume 2, page 567). The finished aluminum oxide layer was 60 microns in thickness. The conducting core 5 was then heated in a vacuum oven, 30 inches mercury, to a temperature of 150° C. which temperature was achieved in 40 minutes. The cylinder was maintained at this temperature and pressure for four hours prior to impregnation.

A beaker of zinc stearate was preheated to melt the compound. The heated cylinder was removed from the oven and coated with the melted zinc stearate using a paint brush. The cylinder was then placed in the vacuum oven for a few minutes at 150° C., 30 inches mercury, thereby forming dielectric surface layer 3. The cylinder was removed from the oven and allowed to cool. After cooling, the member was polished with successively finer SiC abrasive papers and oil. Finally, the member was lapped to a 4.5 microinch finish.

The pressure roller 11 consisted of a solid machined two inch diameter aluminum core 12 over which was press fit a two inch inner diameter, 2.5 inch outer diameter polysulfone sleeve 13. The dielectric roller 1 was gear driven from an AC motor to provide a surface speed of 12 inches per second. The transfer roller 11 was rotatably mounted in spring-loaded side frames, causing it to press against the dielectric cylinder with a pressure of 300 pounds per linear inch of contact. The side frames were machined to provide a skew of 1.1° between rollers 1 and 11.

A charging head of the type described in U.S. Pat. No. 4,160,257) was manufactured as follows. A 1 mil stainless steel foil was laminated on both sides of a 1 mil sheet of Muscovite mica. The stainless foil was coated with resist and photoetched with a pattern similar to that shown in FIG. 5, with holes or apertures in the fingers approximately 0.006 inch in diameter. The complete print head consisted of an array of 16 drive lines and 96 control electrodes which formed a total of 1536 crossover locations capable of placing 1536 latent image dots across a 7.68 inch length of the dielectric cylinder. Corresponding to each crossover location was a 0.006 inch diameter etched hole in the screen electrode. Bias potentials of the various electrodes were as follows (with the cylinder's conducting core maintained at ground potential):

screen potential: −600 volts control electrode potential: −300 volts (during the application of a −300 volts print pulse, this voltage becomes −600 volts)

driver electrode bias: −600 volts

The DC extraction voltage was supplied by a pulse generator, with a print pulse duration of 10 microseconds. Charging occured only when there was simultaneously a pulse of negative 300 volts to the fingers 44, and an alternating potential of 2 kilovolts peak to peak at a frequency of 1 Mhz supplied between the fingers 44 and selector bars 43. The print head was maintained at a spacing of 8 mils from dielectric cylinder 3.

Under these conditions it was found that a 300 volt latent electrostatic image was produced on the dielectric cylinder in the form of discrete dots. The image was toned using single component toning apparatus essentially identical to that employed in the Develop KG Dr. Eisbein and Company (Stuttgart) No. 444 copier. The toner employed was Hunt 1186 of the Phillip A. Hunt Chemical Corporation. Plain paper was injected into the pressure nip at the appropriate time from a sheet feeder.

Digital control electronics and a digital matrix character generator, designed according to principles well known to those skilled in the art, were employed in order to form dot matrix characters. Each character had a matrix size of 32 by 24 points. A shaft encoder mounted on the shaft of the dielectric cylinder was employed to generate appropriate timing pulses for the digital electronics.

Flexible steel scraper blades 15 were employed to maintain cleanliness of dielectric cylinder 1 and transfer cylinder 11. With reference to the electrostatic image erasing embodiment shown at 30 in FIG. 3 the residual latent image was erased using an AC corona 31 in combination with a 42 percent open area 90 mesh screen 33, which was maintained at ground potential and pressed into light contact with the dielectric surface 3. A 3 mil diameter tungsten coated wire 31 was spaced 3/16 of an inch from the screen. The corona wire was operated at an AC 60 Hertz potential with a peak of 9 kilovolts.

No image fusing was required other than that occurring during pressure transfer. The transfer efficiency (i.e. percentage of toner transferred from the cylinder to plain paper) was 99.9 percent.

The printer provided high quality dot matrix images when operated at paper throughout speeds of 12 inches per second with a dot matrix density of 200 dots/inch across the sheet and 300 dots per inch resolution in the direction of sheet travel.

EXAMPLE TWO

The printer of Example One was modified by substituting a print head of the type illustrated in FIG. 6. The insulating support 51 comprised a G-10 epoxy fiberglass circuit board. Control electrodes 54, 56, 58, etc. were formed by photoetching a 1 mil stainless steel foil which had been laminated to insulating substrate 51, providing a parallel array of 5 mil wide strips at a separation of 10 mils. The driver electrode 63 consisted of a 5 mil tungsten wire coated with a 1.5 mil layer of fused glass to form a structure having a total diameter of 8 mils.

AC excitation was provided by a gated Hartley oscillator operating at a resonant frequency of 1 MHZ. The applied voltage was in the range of 2000 volts peak to peak with a pulse width of 10 microseconds, and repetition period of 500 microseconds. A 300 volt DC extraction potential was applied to selected control electrodes.

This printer exhibited equivalent performance to that of the printer of Example One.

EXAMPLE THREE

The electrographic printer of Example One was modified by substituting a print head of the type illustrated in FIG. 7. The insulating substrate, glass coated wire, and stainless steel electrodes were fabricated as described in Example Two. The glass coated wires were mounted in rectangular channels 10 mils in width and 6 mils in depth.

This printer exhibited equivalent performance to that of the printer of Example One.

While various aspects of the invention have been set forth by the specification, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. Electrostatic printing apparatus comprising:

an imaging member having a conductive core and a dielectric surface layer;

means for generating ions comprising control and driver electrodes separated by a dielectric member, and a varying potential applied between the two electrodes to create a glow discharge;

means for extracting ions from said glow discharge to create a latent electrostatic image on said dielectric surface layer;

means for toning said latent electrostatic image; and a transfer roller which nips said dielectric surface layer under pressure, with an image receptor fed through the nip.

2. Apparatus as defined in claim 1 wherein said control and driver electrodes are in contact with opposite sides of a solid dielectric member, with an edge surface of said control electrode disposed opposite said driver electrode to define an air region at the junction of said edge surface and said solid dielectric member.

3. Apparatus as defined in claim 2 wherein said control and driver electrodes comprise a multiplicity of electrodes contacting a dielectric sheet and forming cross points in a matrix array, configured such that the driver electrodes on one side of said dielectric sheet comprise selector bars, and the control electrodes on the other side of said dielectric sheet comprise air breakdown electrodes transversely oriented with respect to said selector bars with apertures at matrix crossover regions.

4. Apparatus as defined in claim 1 wherein the extracting means comprises an extraction potential between the control electrode and the conductive core of said imaging member, further comprising:

a third, "screen" electrode;

a solid dielectric layer separating said screen electrode from the control electrode and the solid dielectric member;

a "screen" voltage between the screen electrode and the conductive core of said imaging member, said screen electrode and solid dielectric layer being apertured to permit the extraction of ions from said glow discharge.

5. Apparatus as defined in claim 4 wherein said screen voltage has a magnitude greater than or equal to 0 and the same polarity as said extraction potential.

6. Apparatus as defined in claim 4 wherein the screen voltage is smaller than the extraction potential in absolute value, and of the same polarity.

7. Apparatus as defined in claim 4, wherein the electrostatic image has an "image potential" with respect to said conductive core, and wherein the screen voltage is larger in magnitude than said image potential in order to prevent undesired image erasure.

8. Apparatus as defined in claim 1 wherein the driver electrode comprises an elongate conductor, the dielectric member comprises a dielectric sheath for said elongate conductor, and the control electrode comprises a conductive member transversely oriented with respect to said elongate conductor, said conductive member being disposed in contact with or closely spaced from said dielectric sheath.

9. Apparatus as defined in claim 8, further comprising an insulating substrate to support the elongate conductor, dielectric sheath, and conductive member.

10. Apparatus as defined in claim 9 wherein the insulating substrate includes a slot, the elongate conductor and dielectric sheath are mounted in said slot, and the conductive member is transversely mounted on said insulating substrate.

11. Apparatus as defined in claim 10 wherein said conductive member comprises a strip.

12. Apparatus as defined in claim 10 wherein said conductive member comprises a wire.

13. Apparatus as defined in claim 9 wherein the conductive member comprises a conductive strip mounted on said insulating substrate, and said elongate conductor and dielectric sheath are transversely mounted over said conductive strip.

14. Apparatus as defined in claim 8 wherein said elongate conductor and said dielectric sheath comprise a wire coated with a thick dielectric.

15. Apparatus as defined in claim 8 wherein the dielectric sheath is comprised of an inorganic dielectric material.

16. Apparatus as defined in claim 8 wherein the driver electrode comprises a multiplicity of elongate conductors with dielectric sheaths, which form crosspoints in a matrix array with a multiplicity of conductive members.

17. Apparatus as defined in claim 1 wherein said transfer roller includes a stress-absorbing plastic surface layer.

18. Apparatus as defined in claim 17 wherein said transfer roller includes a surface layer comprised of an engineering thermoplastic or thermoset material.

19. Apparatus as defined in claim 18 wherein the plastic material is chosen from the class consisting of nylon or polyester.

20. Apparatus as defined in claim 1 further comprising a device placed adjacent to the dielectric surface of said imaging member to erase any latent residual electrostatic image after image transfer.

21. Apparatus as defined in claim 26 wherein the erase device comprises a grounded conductor or grounded semiconductor which is maintained in intimate contact with the dielectric surface layer.

22. Apparatus as defined in claim 26 wherein the erase device comprises two electrodes separated by a solid dielectric member with an alternating potential applied between the two electrodes to create a glow discharge, wherein one of said electrodes is maintained at the same potential as the conductive core of said imaging member.

23. Electrostatic printing apparatus as defined in claim 1 wherein the means for extracting ions comprises an extraction potential between the control electrode and the conductive core of said imaging member.

24. Electrostatic printing apparatus comprising:

an imaging member having a conductive core and a dielectric surface layer;

means for generating ions comprising an elongate conductor, a dielectric sheath for said elongate conductor, and a conductive member transversely oriented with respect to said elongate conductor, said conductive member being disposed in contact with or closely spaced from said dielectric sheath, and a time varying potential applied between the elongate conductor and the conductive member to create a glow discharge in proximity to the conductive member and dielectric sheath;

means for extracting ions from said glow discharge to create a latent electrostatic image on said dielectric surface layer;

means for toning said latent electrostatic image; and a transfer roller which nips said dielectric surface layer under pressure, with an image receptor fed through the nip.

25. Electrostatic printing apparatus as defined in claim 24 wherein the extracting means comprises an extraction potential between the conductive member and the conductive core of said imaging member.

26. Apparatus as defined in claim 24 wherein the extracting means comprises an extraction potential between the control electrode and the conductive core of said imaging member, further comprising:

a third, "screen" electrode;

a solid dielectric layer separating said screen electrode from the conductive member and the dielectric sheath;

a "screen" voltage between the screen electrode and the conductive core of said imaging member, said screen electrode and solid dielectric layer being apertured to permit the extraction of ions from said glow discharge.

27. Electrostatic printing apparatus as defined in claim 1 wherein said imaging member is cylindrical.

28. Apparatus as defined in claim 27 wherein the ion generating means is spaced from said cylindrical imaging member by more than 1 mil.

29. Apparatus as defined in claim 27 wherein said transfer roller is maintained in contact with said cylindrical imaging member at a pressure in the range from 100 to 700 pounds per linear inch.

30. Apparatus as defined in claim 27 wherein said cylindrical imaging member has a smoothness is excess of about 20 microinch rms and a resistivity in excess of about $10^{12}$ ohm-centimeters.

31. Apparatus as defined in claim 27 wherein said cylindrical imaging member comprises an aluminum cylinder with a porous anodized oxide surface layer impregnated with an insulating material.

32. Apparatus as defined in claim 31 wherein the insulating material comprises an organic resin.

33. Apparatus as defined in claim 31 wherein the insulating material comprises a metallic salt of a fatty acid.

34. Apparatus as defined in claim 27 further comprising two metal scrapers placed adjacent to said cylindrical imaging member in order to clean the member's surface after image transfer.

35. Apparatus as defined in claim 27 wherein said transfer roller is maintained in a non-parallel axial orientation with respect to said cylindrical imaging member.

* * * * *